United States Patent [19]

Marchese et al.

[11] 4,321,048

[45] Mar. 23, 1982

[54] MECHANIZED WATER BOARD

[76] Inventors: Michele J. Marchese; William R. W. Troxel, both of 845 St. Kathrine Dr., Flintridge, Calif. 91011

[21] Appl. No.: 82,782

[22] Filed: Oct. 9, 1979

[51] Int. Cl.[3] ..... A63C 5/00; A63C 9/00; A63C 11/00; A63C 15/00

[52] U.S. Cl. ..... 440/32; 440/31; 440/69; 440/48; 441/74

[58] Field of Search ..... 9/310 E; 114/61; 440/70, 69, 21, 24, 25, 26, 27, 31, 32, 48

[56] References Cited

U.S. PATENT DOCUMENTS

| | | | |
|---|---|---|---|
| 1,186,413 | 6/1916 | Merrill | 440/31 |
| 1,324,687 | 12/1919 | Newby | 9/310 E |
| 2,285,023 | 6/1942 | Fergus | 440/70 |
| 3,031,692 | 5/1962 | Riek | 114/61 |
| 3,408,976 | 11/1968 | Ellis | 9/310 E |
| 3,809,003 | 5/1974 | Foldvari | 9/310 E |

FOREIGN PATENT DOCUMENTS

| | | | |
|---|---|---|---|
| 450841 | 8/1949 | Italy | 440/32 |

*Primary Examiner*—Edward R. Kazenske
*Assistant Examiner*—D. W. Keen
*Attorney, Agent, or Firm*—G. Donald Weber, Jr.

[57] ABSTRACT

There is disclosed a water board or surfboard wherein a screw propeller mounted on the underside of the board generates thrust in response to the push-pull action of a hand lever which protrudes from either side of the board. The push-pull action on the lever causes a ratchet-type mechanism to rotate a gear assembly which is connected to the screw propeller shaft.

7 Claims, 5 Drawing Figures

MECHANIZED WATER BOARD

BACKGROUND

1. Field of the Invention

This invention is directed to surfboards, in general, and to a manually propelled surfboard, in particular.

2. Prior Art

There are many known surfboards or similar devices available on the market today. The interest in this type of device has increased steadily over the years, especially with the advent of financially rewarding competitions and the like. Surfboarding, as a sport, has triggered the advent of new and different designs, such as the "boogie board" and the like.

These boards provide various types of enjoyment and sporting activity. In addition, the boards are used in providing various kinds of exercise for the user. However, many surfboard users do not have the appropriate or requisite skill to use the surfboard in the ultimate manner, i.e., surfing. On the other hand, many people desire to use surfboards in obtaining exercise in an aquatic environment. In addition, even those who are relatively skillful still find it necessary or desirable to paddle the surfboard from one location to another in search of a suitable wave or a suitable location for using the surfboard. In this case, the user merely sits or lies on the surfboard and paddles with his/her hands. However, this is an extraordinarily slow and inefficient method of manuever or manipulation.

Of course, mobility can be obtained by adding a sail or the like, but the surfboard then becomes virtually unusable for surfing activities. Consequently, new designs in the area of surfboards are highly desirable.

PRIOR ART STATEMENT

The most pertinent prior art known is known listed herewith.

U.S. Pat. No. 1,324,687—Newby. This patent is related to a catamaran-type surfboard with propulsion means.

U.S. Pat. No. 3,031,692—Riek. This patent is related to a boat which can be operated by a foot-activated paddle wheel.

U.S. Pat. No. 3,408,976—Ellis. This patent is related to a surfboard with propulsion means.

U.S. Pat. No. 3,809,003—Foldvari. This patent is related to a mechanically propelled water craft.

SUMMARY OF THE INVENTION

This invention is directed to a manually propelled surfboard wherein the push-pull action of a hand lever which rotates about a vertical axis causes a ratchet gear to rotate about the vertical axis. The ratchet gear mechanism drives a gear assembly which is connected to a screw propeller shaft. The propeller shaft drives a screw propeller, thereby producing thrust such that the surfboard is impelled forward.

DESCRIPTION OF A PREFERRED EMBODIMENT

Figure 1:
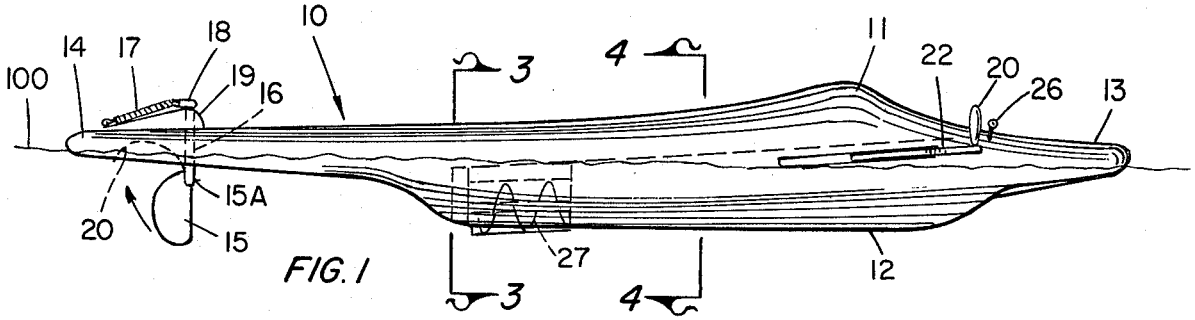
FIG. 1 is a side view of a preferred embodiment of the surfboard of the instant invention.

Referring now to FIG. 1, there is shown a partially broken-away side view of the surfboard 10, which forms the instant invention. The surfboard includes upper portion 11, lower portion 12, front end 13, and tail end 14. The front end 13 and tail end 14 are of a configuration which is fairly conventional in surfboards. The upper portion 11 of the surfboard 10 has a raised area which receives the drive mechanism (see FIG. 5) and, as well, provides a resting area for the body of the surfboard user. The bottom portion 12 of the surfboard includes a depending portion which somewhat resembles a catamaran configuration. Surfboard 10 can be fabricated of any suitable material such as but not limited to polyurethane. Typically, the surfboard will be fabricated by a conventional molding process.

Figure 2:
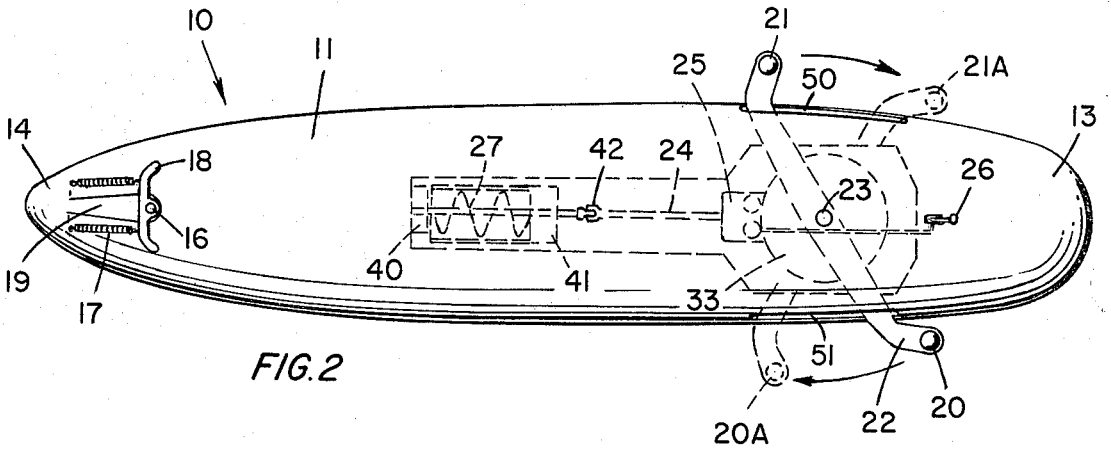
FIG. 2 is a top view of the surfboard of the instant invention.

Referring now to FIG. 2, there is shown a top view of the surfboard 10. In this view, it is clear that the surfboard has a relatively conventional configuration with a rounded front 13 and a relatively pointed tail end 14.

Referring to FIGS. 1 and 2 concurrently, it is seen that rudder 15 depends from the lower surface of the surfboard adjacent to tail end 14. Rudder 15 is hingedly joined to rudder shaft 16 by a suitable pivot 43. Shaft 16 is joined to the foot control apparatus 18 which, in this embodiment, includes an appropriate configuration to receive the surfboard user's feet. Springs 17 are joined to foot control 18 and to the upper surface of surfboard 10. The springs cause rudder 15 to be substantially centered until foot control 18 is moved by the surfboard user. A raised portion 19 can be provided to support rod 16 and foot control 18 if so desired. In addition, a receptacle 20, shown dashed, is provided in the tail end 14 of surfboard 10 to receive rudder 15 during transporting of surfboard 10 or in the event the surfboard is used in shallow water or the like.

The surfboard is driven by a suitable screw propeller 27 which is schematically shown. The propeller is mounted by suitable mounting devices 40 and 41 at either end thereof. The mounting devices 40 and 41 may include bushings, bearings and the like. The shaft of propeller 21 is coupled to drive shaft 24. This coupling can be either direct or through a universal joint 42, if desired. Drive shaft 24 is connected to gear box 25 which will be described in greater detail hereinafter. A drive mechanism which includes ratchet-type wheel 33 is mounted in the raised portion of the upper surface 11 of surfboard 10. The drive mechanism (which may comprise two (2) ratchet wheels) further includes lever arm 22 which is mounted to the ratchet wheels by means of axle 23. Handles 20 and 21 are provided at the outer extremities of lever arm 22. Lever arm 22 extends through slots 50 and 51 on the opposite sides of surfboard 10. In a preferred embodiment, slots 50 and 51 are disposed in the upper portion 11 of surfboard 10, for example above the normal water line. A gear lever 26 is mounted near the leading edge 13 of surfboard 10 and is connected to gear box 25 to provide a gear shifting capability, if so desired.

Figure 3:
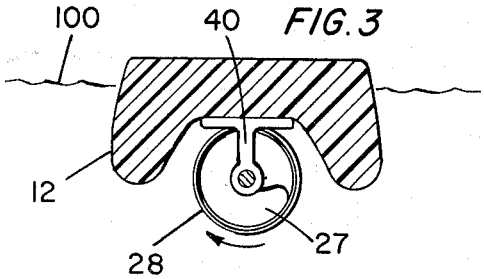
FIG. 3 is a cross-sectional view of the surfboard taken along the lines 3—3 in FIG. 1.

FIG. 3 is a cross-sectional view of the surfboard taken along the lines 3—3 as shown in FIG. 1. In this view, the catamaran-type configuration is suggested. In actuality, the configuration may represent a channel which is formed in the surfboard 10 to receive the propeller, shaft and other drive mechanism components. In particular, the screw propeller 27 is mounted in any suitable fashion to a mounting bracket 40 which is affixed to the surfboard 10. In a preferred embodiment, a tubular member 28 is formed around screw propeller 27 to control and enhance the propulsion action of the screw propeller. In addition, the tube may provide protection to (and from) the propeller. In some cases, the tube 28 may be formed as an integral portion of the surfboard 10. Conversely, tube 28 can be a separate element. Moreover, it is conceivable that tube 28 may have a tapered or generally conical configuration to improve the propulsion characteristics of the device.

Figure 4:
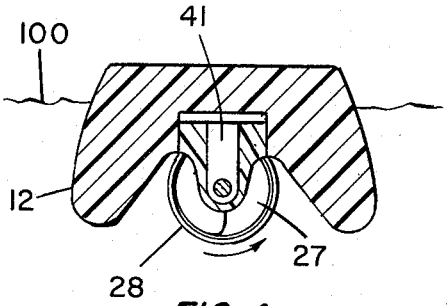
FIG. 4 is a cross-sectional view of the surfboard taken along the lines 4—4 in FIG. 1.

Referring now to FIG. 4, there is shown a cross-sectional view of the surfboard apparatus taken along the lines 4—4 of FIG. 1. Again, the surfboard configuration is shown as well as the mounting device 41 which is used to mount screw propeller 27 and tube 28.

Figure 5:
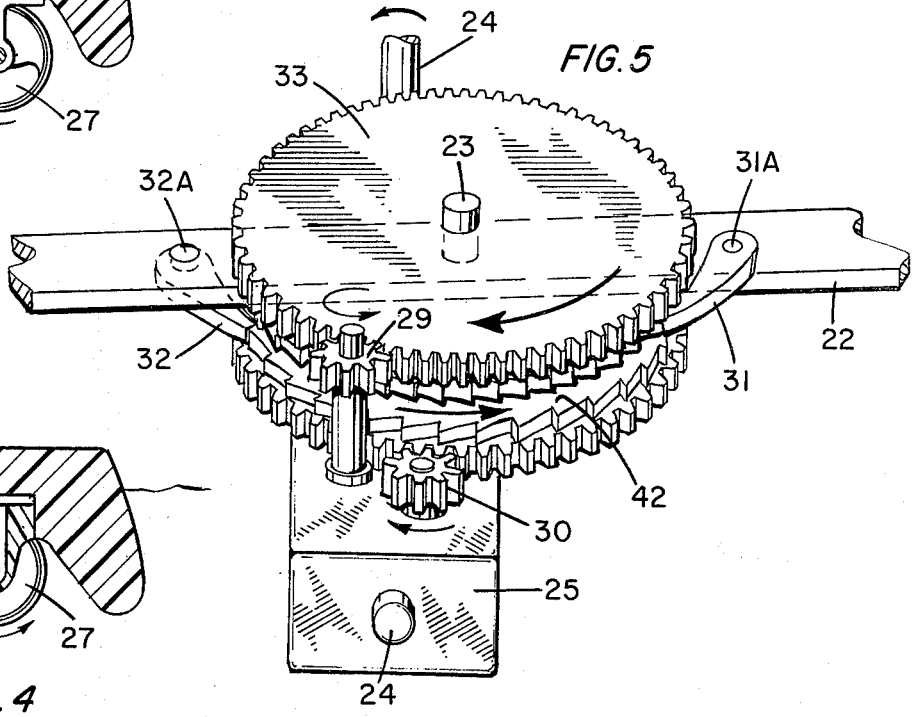
FIG. 5 is a more detailed showing of the ratchet portion of the drive mechanism of the instant invention.

Referring now to FIG. 5, there is shown a more detailed representation of the drive mechanism. In this illustration, the lever 22 includes ratchets 31 and 32 on the upper and lower surfaces thereof respectively. The ratchets 31 and 32 are pivotally mounted in a conventional manner. Lever 22 is mounted to rotate around axis 23. Axis 23 also passes through ratchet wheels 33 and 42 which are able to rotate around the axis. Each of ratchet wheels 33 and 42 include an outer perimeter which includes gear teeth of any suitable configuration. Each of the ratchet discs also includes an inner periphery which is arranged to have ratchet teeth thereon. The ratchet teeth in the respective ratchet wheels are arranged in counter-directions wherein the ratchet teeth on disc 33 are engaged by ratchet 31 while the ratchet teeth on disc 42 are engaged by ratchet 32.

Gear drives 29 and 30 are, effectively, idler gears which are driven by ratchet wheels 33 and 42, respectively. These gears 29 and 30 are connected to gear box 25 to cause drive shaft 24 to be driven thereby driving screw propeller 27.

In operation, the surfboard user places the surfboard on the surface of the body of water 100. The user then mounts the surface board 10, typically in a prone position with the feet positioned against foot control 18. The user then grasps handles 20 and 21 in his hands and is ready to begin operation. By pulling on handle 20 and pushing on handle 21, the lever is moved to positions 20A and 21A, shown dashed. In this movement, one of the ratchets, (e.g., ratchet 31), has been pulled into an engagement with the ratchet teeth on ratchet wheel 33 causing this wheel to rotate in the clockwise direction as indicated by the arrow (FIG. 5). Ratchet wheel 23 is also in engagement with gear 29 which is driven in the counterclockwise direction. Gear 29 causes the gear arrangement in gear box 25 to cause drive shaft 24 to rotate counterclockwise and, thus, drive screw propeller 27. Of course, during this operation ratchet 32 moves loosely around the periphery of ratchet wheel 42.

The user then pulls on handle 21 and pushes on handle 22 (the reverse of the previous operation) so that the handle and levers resume the position shown in solid line in FIG. 2. In this operation, ratchet 32 engages the ratchet teeth on ratchet wheel 42 causing this wheel to be driven in the counterclockwise direction. The gear teeth on the periphery of disc 42 engage and drive gear 30 in the clockwise direction. Gear 30 is coupled to drive shaft 24 (via gear box 25) to also cause counterclockwise rotation of the shaft such that screw propeller 27 is driven in the same rotational direction as before. In this operation, ratchet 31 and ratchet wheel 33 are disengaged. By continuing the push-pull operation of the lever, shaft 24 can be, essentially, continuously driven wherein screw propeller 27 is driven to cause propulsion of the surfboard 10.

By manipulation of his feet, the surfboard user can alter the position of foot control 18 thereby adjusting the position of rudder 15 and, thus, the direction of movement of the surfboard 10. In addition, by adjustment of lever 26, gear box 25 can be altered to change the gear ratio therein. The gear ratio can be altered depending upon the surface conditions of the water of the like wherein speed and/or power can be selectively obtained in accordance with the gear ratio selected in gear box 25.

Thus, there has been shown and described a unique surfboard apparatus which permits manual operation and drive relative thereto. The surfboard is useful either as an exercising device with the user in a prone position or can be used in the conventional surfing manner once the user has reached the appropriate location and position. The embodiment shown and described is a preferred embodiment. It must be understood that modifications to the device, as shown, can be made by those skilled in the art. However, any such modifications which fall within the purview of this description are intended to be included therein as well. The description is not intended to be limitative, but is intended to be illustrative only. The scope of the invention is limited only by the claims appended hereto.

Having thus described a preferred embodiment of the instant invention, what is claimed is:

1. A propelled surfboard comprising, an elongated surfboard body member having a generally planar configuration with a front end and a tail end, propulsion means including a screw propeller disposed beneath said body member, and drive means coupled to said propulsion means for causing operation thereof to impart motion to said surfboard, said drive means including lever means pivotally mounted near said front end of said body member and arranged to operate substantially horizontally within the planar configuration of said body member, said drive means further including ratchet wheel means selectively engaged and driven by said lever means, said drive means further including gear means selectively driven by said ratchet wheel means, and drive shaft means connecting said gear means to said propulsion means, said lever means including pawls thereon for engaging said ratchet wheel means, said ratchet wheel means including toothed perimeter edges for driving said gear means.

2. The surfboard recited in claim 1 including, gear lever means connected to said gear means to change the gear ratio therein.

3. The surfboard recited in claim 1 wherein, said body member includes a recessed portion in the underside thereof in which said propulsion means is mounted.

4. The surfboard recited in claim 1 wherein, said propulsion means is disposed substantially midway between said front end and said tail end of said body member.

5. The surfboard recited in claim 1 wherein, said ratchet wheel means comprises a pair of toothed wheels adapted to operate in opposite directions while driving said drive shaft means in the same direction.

6. The surfboard recited in claim 1 including rudder means adjacent said tail end for controlling the direction of motion of said surfboard.

7. The surfboard recited in claim 6 wherein, said rudder means is selectively positionable.

* * * * *